United States Patent [19]

Frahm

[11] 4,114,590

[45] Sep. 19, 1978

[54] AIR FEED FIREPLACE GRATE

[75] Inventor: Harlan C. Frahm, Burlington, Wis.

[73] Assignee: Frahm Fireplace Grate Co., Inc., Burlington, Wis.

[21] Appl. No.: 731,962

[22] Filed: Oct. 13, 1976

[51] Int. Cl.[2] ..... F24B 7/00

[52] U.S. Cl. ..... 126/121; 126/164; 237/51

[58] Field of Search ..... 126/121, 132, 131, 164, 126/165, 122, 109; 237/51

[56] References Cited

U.S. PATENT DOCUMENTS

| | | | |
|---|---|---|---|
| 463,061 | 11/1891 | Lewis | 126/132 |
| 495,418 | 4/1893 | Lewis | 126/164 |
| 1,313,085 | 8/1919 | Greene | 126/121 |
| 2,052,643 | 9/1936 | Modine | 126/121 |
| 4,010,729 | 3/1977 | Egli | 126/121 |
| 4,018,210 | 4/1977 | Christophel | 126/164 |
| 4,019,492 | 4/1977 | Rush | 126/121 |

FOREIGN PATENT DOCUMENTS

| | | | |
|---|---|---|---|
| 226,785 | 2/1960 | Australia | 126/121 |
| 24,575 of | 10/1909 | United Kingdom | 126/165 |
| 978,392 | 12/1964 | United Kingdom | 126/121 |

*Primary Examiner*—William F. O'Dea
*Assistant Examiner*—Harold Joyce
*Attorney, Agent, or Firm*—Andrus, Sceales, Starke & Sawall

[57] ABSTRACT

A fireplace grate includes a pair of spaced, hollow L-shaped side frames. A first group of hollow flues is connected between the horizontal portions of the side frames. The fire is built on this group of flues. A second group of hollow flues is connected between the generally vertical portions of the side frames. A fan, connected to one of the side frames, circulates air through the frames and flues. The air is heated by its passage through the frames and flues and is exhausted into the room from the other side frame.

16 Claims, 4 Drawing Figures

AIR FEED FIREPLACE GRATE

BACKGROUND OF THE INVENTION

Field of the Invention

The present invention relates to a fireplace grate having an air feed.

BACKGROUND AND SUMMARY OF THE INVENTION

A typical fireplace warms the room by the radiation of heat from the fire in the grate. Only a small portion of the heat available from the fire is actually supplied to the room in this manner, the remainder being lost up the chimney.

As a result, it has been proposed to provide means by which additional heat may be extracted from the fire and used for heating purposes. A common technique is to provide a grate formed of hollow pipes for supporting the logs or coal of the open fire. The pipes are heated by conduction from the fire. Air flowing through the pipes becomes heated and is discharged into the room, thereby increasing the amount of heat provided to the room.

U.S. Pat. Nos. 2,052,643; 2,828,078; 3,001,521; and 3,240,206 disclose such constructions. While fireplace grates such as those of the foregoing patents represent an improvement over conventional fireplace grates, the efficiency of heat transfer from the open fire to the room remains rather low.

U.S. Pat. Application Ser. No. 602,236 assigned to the same assignee and now abandoned as this application discloses a forced air fireplace grate having improved efficiency over those described in the above issued U.S. Patents. The grate disclosed in that application includes a pair of hollow U-shaped side frames having upper and lower arms connected by an upstanding support member. Groups of hollow flues extend between each of the upper arms, lower arms and support members. The fire, built on the flues between the lower arms, heats and flues. A fan is connected to the forward end of one of the lower arms and exhausts air through the open forward end of the upper arm of the other side frame.

It has now been discovered that the upper arms and third group of flues may be eliminated with little, if any, loss in heating efficiency. In some cases, efficiency may be improved since the flues between the upper arms remained much cooler than the other two groups of flues so that heat was actually extracted from the latter to heat the former. A smaller fire may be employed with the grate of the present invention with no loss in heat output. The elimination of the upper arms reduces the cost of the fireplace grate, improves its appearance, and enables it to be used with fireplaces having glass doors instead of screens or fireplaces having two or three open sides.

DETAILED DESCRIPTION OF THE PREFERRED EMBODIMENT

Figures 1, 2, 3, 4:
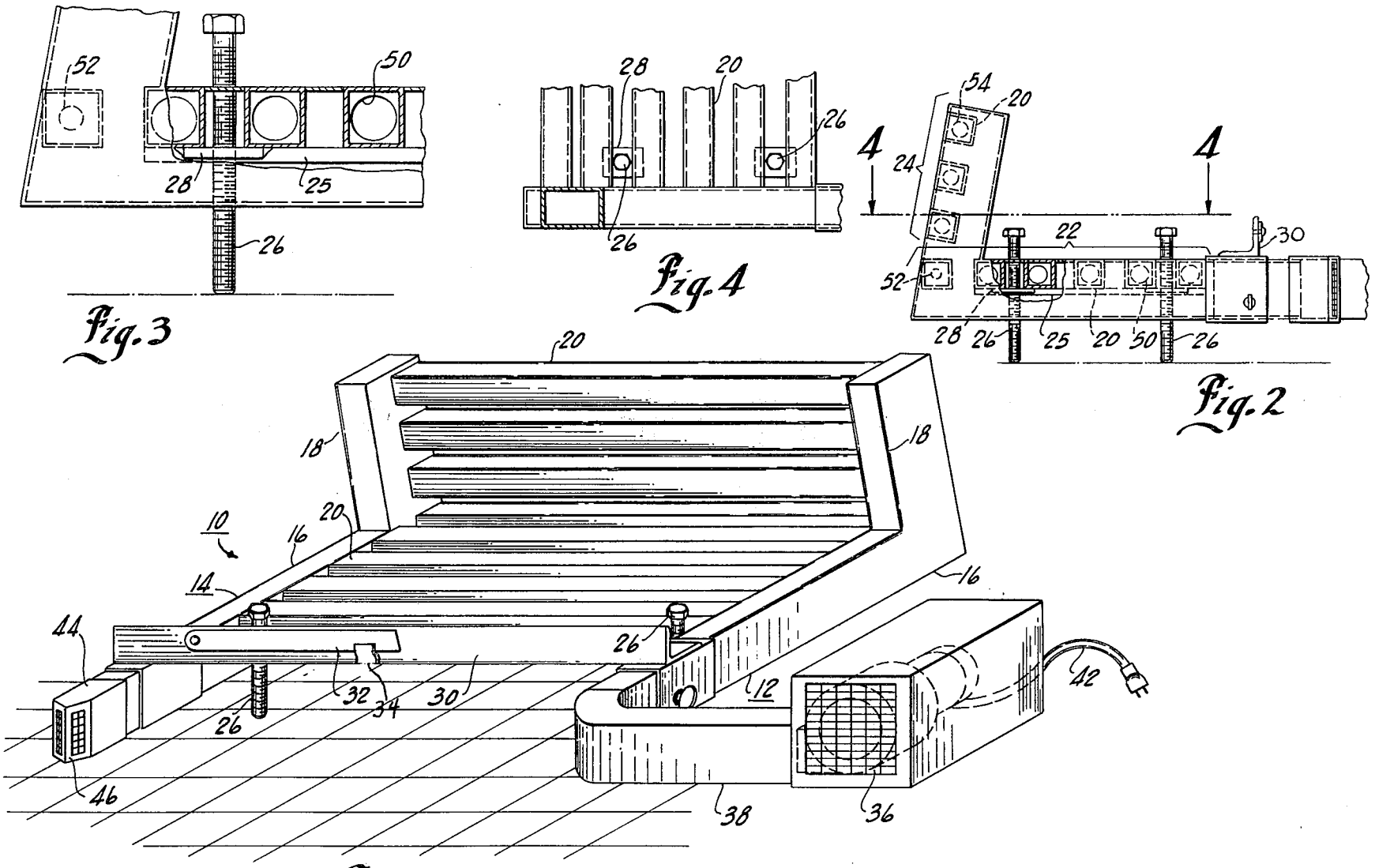
FIG. 1 is a perspective view of the improved fireplace grate of the present invention.
FIG. 2 is a partially broken side view of the fireplace grate of the present invention.
FIG. 3 is an enlarged partial side view of the fireplace grate of the present invention, with portions thereof broken away.
FIG. 4 is a partial plan view taken along the line 4—4 of FIG. 2.

Turning now to the Figures, the improved fireplace grate of the present invention is shown by the numeral 10. Fireplace grate 10 includes a pair of spaced, side frames 12 and 14, respectively. Side frames 12 and 14 are formed as hollow L-shaped members from tubing having a generally rectangular hollow cross section. Each of the side frames includes an arm 16. An upstanding member 18 is mounted on the end of each of arms 16 which is typically positioned toward the rear of the fireplace when grate 10 is in position.

A plurality of flues 20 extend between, and communicate with the interior of, spaced side frames 12 and 14. A first plurality 22 of such flues are spaced in a horizontal plane and extend between arms 16. A second plurality 24 of flues 22 are spaced in a generally vertical stack and extend between upstanding members 22. See FIG. 2. The size of grate 10 is matched to the size of the fireplace. Depending on the size of the grate, the number of flues 20 in first plurality 22 may range between six and eight. Depending on the distance spanned by flues 20 of first plurality 22, the flues may be braced by one or more bars 25 welded to the underside of the flues and running parallel to side frames 12 and 14. The number of flues 20 in said second plurality 24 is three. The number of these flues does not usually change as the size of the grate changes. The flues of the second plurality 24 are preferably mounted along the rear edge of upstanding members 18 to provide increased depth for firebuilding and better air flow. Legs 26 may be mounted in plates 28 affixed to flues 20 of first plurality 22 as shown in FIG. 3. The lateral position of legs 26 may be altered depending on the distance spanned by flues 20 so as to move the legs inward from side frames 12 and 14 as the span is increased, thereby to prevent warping of the flues.

Bar 30, formed of angle iron or the like, extends between the forward ends of arms 16 to retain the combustible materials on the first plurality 22 of flues 20. A rod 32 may be pivotally mounted on raised bar 28 and retained by bracket 34. Rod 32 is pivoted downward to position the front end of grate 10 in a raised position to permit removal of the accummulated ashes. The forward slant to the upper ends of upstanding members 18 facilitates tipping of the grate.

A means for circulating air through side frames 12 and 14 and flues 20 is provided in the forward end of the arm 16 of one of the side frames, shown as side frame 12 in FIG. 1. Such a means may comprise a fan 36 connected to side frame 12 by duct 38. The fan may be energized from a conventional electrical outlet by line cord 42.

The forward end of arm 16 of the other side frame 14 is open to form a discharge means 44 for the air provided by fan 36. Discharge means 44 may include a diffuser means 46 to direct the discharge into the room. Discharge means 44 may mate with a corresponding opening in the fireplace screen, may extend through the screen, or may be positioned behind the screen. The upper ends of upstanding members 18 are sealed.

To maximize the heating efficiency of grate 10, it has been found highly desirable to provide differently sized openings between side frames 12 and 14 and flues 20. To provide communication between flues 20 and side frames 12 and 14, holes are drilled at predetermined locations on the frames. Flues 20 may then be butt welded to side frames 12 and 14 over the holes. The size of the holes may be varied to vary the opening between the side frames and the flues. As shown most clearly in FIG. 3, it has been found preferable to have large holes 50 connecting the flues 20 of first plurality 22 to side frames 12 and 14 with the exception of the rearward most flue which has a much smaller hole 52. The holes 54 connecting flues 20 of second plurality 24 are smaller than holes 50 but larger than hole 52. The foregoing arrangement provides the greatest air flow through the hotter flues.

In use, combustible material, such as wood or coal, is laid on the first plurality 22 of flues 20 and ignited. The first plurality of flues 22 are in direct contact with the fuel of the fire and thus become heated by conduction as well as by radiation. The second plurality of flues 24 are similarly heated.

Fan 36 is energized to force air into side frame 12 through duct 38. The air flows through the heated side frame 12 and flues 20 into side frame 14 and exits out discharge means 44 of side frame 14 to heat the room. The large surface area of fireplace grate 10 heated by the fire and to which the air is exposed during its passage through the grate assists in increasing the amount of heat supplied to the room.

Fan 36 may typically provide 76 c.f.m. of air to side frame 12. Approximately 56 c.f.m. of air is discharged from side frame 14 at 3°–400° F. Side frames 12 and 14 are formed of 2 × 3 inches rectangular tubing. Flues 20 are $1\frac{1}{2} \times 1\frac{1}{2}$ inch rectangular tubing. Flues 20 may be spaced 1 inch apart so as to retain the combustible material on the grate.

Various modes of carrying out the invention are contemplated as being within the scope of the following claims particularly pointing out and distinctly claiming the subject matter which is regarded as the invention.

I claim:

1. A grate suitable for positioning in a fireplace opening into a room, said grate receiving combustible material and comprising:

a pair of spaced, hollow side frames lying generally perpendicular to the opening of the fireplace, each of said frames comprising a generally horizontal hollow arm member of generally rectangular cross section, said arm member having an opening at a first end located adjacent the opening of the fireplace and a second end joined to the lower end of an upstanding hollow support member having the cross section configuration of said arm member, said arm member and said upstanding support member lying in a generally vertical plane and forming a hollow conduit;

a first plurality of hollow flues extending laterally between, and communicating with the interior of, said arm members of said side frames, said first plurality of flues being spaced from each other in a generally horizontal plane and capable of receiving and supporting combustible material;

a second plurality of hollow flues extending laterally between, and communicating with the interior of, said upstanding support members of said side frames for retaining said combustible material on said first plurality of hollow flues, each of said second plurality of flues being spaced from those above or below it, the burning of the combustible material heating the flues of said first plurality a greater amount than said second plurality;

means coupled to the first end of said arm member of one of said side frames for providing an air flow into one of said side frames, through said flues, and out the first end of said arm member of the other of said side frames for discharge into the room, the upper ends of said upstanding members being closed; and connection means associated with said flues and side frames establishing differing amounts of communication and flow through different ones of said flues and controlling the air flow through said respective flues to increase the air flow through the first flues relative to the air flow through the second flues.

2. The improved grate according to claim 1 wherein said connection means between said flues and said side frames comprises holes in said side frames embraced by said flues and wherein said holes differ in size.

3. The improved grate according to claim 2 wherein said holes for the flues of said first plurality adjacent to said first end of said arms are larger than those of said second plurality.

4. The improved grate according to claim 2 wherein said holes for the flues of said first plurality adjacent to said first end of said arms are larger than that for the flue located most distant from said first end.

5. The improved grate according to claim 4 wherein said holes for the flues of said second plurality are smaller than those of said adjacent flues of said first plurality but larger than that of said most distant flue.

6. The improved grate according to claim 1 wherein said hollow flues are rectangular in cross section.

7. The improved grate according to claim 1 wherein said means for forcing air into said side frames and flues comprises a fan connected to the first end of said lower arm member of one of said side frames.

8. The improved grate according to claim 1 including means for supporting said grate with the first ends of said arms in a raised position.

9. The improved grate according to claim 1 including means adjacent said first ends of said arms for retaining said combustible material on said first plurality of hollow flues.

10. The improved grate according to claim 1 wherein the number of flues in said first plurality is varied as the size of the grate is varied.

11. The improved grate according to claim 10 wherein the number of flues in said second plurality remains constant as the size of the grate is varied.

12. The improved grate according to claim 1 including leg means for positioning the grate in the fireplace.

13. The improved grate according to claim 1 wherein said upstanding hollow support member has a forward edge facing said combustible material and a rear edge and wherein said second plurality of hollow flues is positioned adjacent said rear edge of said upstanding member.

14. The improved grate according to claim 12 wherein said leg means are mounted on the flues of said first plurality and laterally positioned to establish the unsupported span of said flues.

15. The improved grate according to claim 1 including bracing means fastened to said first plurality of flues for reducing warpage of the flues.

16. The improved grate according to claim 1 wherein said hollow flues are smaller in cross section than said side frames.

* * * * *